US011286028B1

(12) United States Patent
Woody

(10) Patent No.: US 11,286,028 B1
(45) Date of Patent: Mar. 29, 2022

(54) WATERCRAFT ADJUSTABLE SHAFT SPACING APPARATUS AND RELATED METHOD OF OPERATION

(71) Applicant: Platinum Marine Inc., Pinconning, MI (US)

(72) Inventor: Clark M. Woody, Pinconning, MI (US)

(73) Assignee: Platinum Marine Inc., Pinconning, MI (US)

( * ) Notice: Subject to any disclaimer, the term of this patent is extended or adjusted under 35 U.S.C. 154(b) by 0 days.

(21) Appl. No.: 16/953,936

(22) Filed: Nov. 20, 2020

(51) Int. Cl.
*B63H 23/06* (2006.01)
*B63H 5/125* (2006.01)

(52) U.S. Cl.
CPC ..... *B63H 23/06* (2013.01); *B63H 5/1252* (2013.01)

(58) Field of Classification Search
CPC ..... B63H 5/125; B63H 5/1252; B63H 20/22; B63H 23/06
See application file for complete search history.

(56) References Cited

U.S. PATENT DOCUMENTS 1,780,552 A 11/1930 Coggins et al.
2,667,087 A 1/1954 Myers
2,705,468 A 4/1955 Dix
2,957,441 A 10/1960 Leipert
3,626,467 A 12/1971 Mazziotti
4,244,454 A 1/1981 Bankstahl
4,544,362 A 10/1985 Arneson
4,565,532 A 1/1986 Connor
4,645,463 A 2/1987 Arneson
4,728,308 A 3/1988 Weismann
4,764,032 A 8/1988 Tanaka
4,775,342 A * 10/1988 Connor ..... B63H 5/1252 440/57
4,790,782 A 12/1988 McCormick
4,815,996 A 3/1989 Carr
5,326,294 A 7/1994 Schoell
5,415,576 A 5/1995 Meisenburg et al.
5,647,780 A 7/1997 Hosoi
5,791,954 A 8/1998 Johnson, Jr.
5,863,230 A 1/1999 Morrison
5,934,955 A 8/1999 Heston
5,964,627 A 10/1999 Detwiler
6,383,043 B1 5/2002 Heston
6,431,927 B1 8/2002 Sage
6,468,119 B1 10/2002 Hasl et al.
6,523,655 B1 2/2003 Behara
6,960,107 B1 11/2005 Schaub et al.
7,163,427 B1 1/2007 Lee
(Continued)

*Primary Examiner* — Andrew Polay
(74) *Attorney, Agent, or Firm* — Warner Norcross + Judd LLP

(57) ABSTRACT

An outdrive for a marine vessel, such as a watercraft having an inboard engine, includes a standoff box configured to continuously provide power to the drive unit as the drive unit vertically moves from a raised mode to a lowered mode, thereby lowering a thrust point produced by a propeller, all while the watercraft is moving through water and while the propeller is producing thrust. The standoff box can include one or more idler gears that move via a system of brackets relative to an input gear and a transfer gear to maintain rotational engagement between the input gear and the transfer gear, which is joined with the drive unit to rotate the propeller. A related method also is provided.

20 Claims, 12 Drawing Sheets

(56) References Cited

U.S. PATENT DOCUMENTS

| | | | | |
|---|---|---|---|---|
| 7,985,109 | B2 | 7/2011 | Mansfield et al. | |
| 9,708,045 | B1 | 7/2017 | Woody | |
| 9,758,225 | B1 | 9/2017 | Woody | |
| 9,914,518 | B2 | 3/2018 | Woody | |
| 9,969,476 | B2 | 5/2018 | Woody | |
| 10,207,785 | B2 | 2/2019 | Woody | |
| 2006/0057910 | A1* | 3/2006 | Stallings | B63H 20/34 440/79 |
| 2008/0045094 | A1* | 2/2008 | Beachy Head | B63H 5/1252 440/53 |
| 2009/0117791 | A1 | 5/2009 | Huddleston | |

* cited by examiner

WATERCRAFT ADJUSTABLE SHAFT SPACING APPARATUS AND RELATED METHOD OF OPERATION

BACKGROUND OF THE INVENTION

The present invention relates to watercraft, and more particularly to a watercraft outdrive that can move a propeller and its shaft relative to a watercraft bottom while the watercraft is under power.

There is a variety of watercraft used in different activities. Some watercraft is used for commercial purposes, while others are used for recreation and/or competition. Many watercraft or boats are constructed to include an inboard motor. In such a construction, the engine of the boat is located inside the hull of the boat, while an outdrive projects rearward from the stern of the boat. The outdrive typically includes a transmission that transfers rotational forces from the engine to a propeller shaft and an associated propeller. Upon rotation, the propeller produces thrust to propel the boat through water.

Conventional outdrives of inboard watercraft typically are constructed so that the outdrive can tilt about a pivot point tilt the propeller upward or tilt the propeller downward. Upon such tilting, however, the angle of the propeller and the associated thrust changes significantly. For example, when an outdrive is tilted upward, the tilted angle of the propeller makes maneuvering the boat more difficult because the thrust is projected upward toward the water surface instead of being projected rearward, behind the boat.

Even with such tilt features an issue with conventional outdrives of inboard watercraft is that the vertical displacement of the propeller shaft and propeller is generally fixed and immovable relative to the bottom of the watercraft. With this fixed relationship relative to the bottom of the watercraft, conventional outdrives fail to effectively provide vertical adjustment of the propeller shaft and propeller, and thus the thrust point.

To address the fixed relationship of the propeller shaft relative to the bottom, some designers have developed mechanisms to alter that relationship. For example, Platinum Marine, Inc. of Pinconning, Mich. has designed several outdrives having special standoff boxes that facilitate raising and lowering of the thrust point. Examples of these constructions are shown, for example, in U.S. Pat. Nos. 9,758,225; 9,914,518; 9,919,782 and 10,207,785 to Woody. While these standoff boxes are effective, they include special U-joint configurations, ball splines and/or split standoff boxes that can sometimes be complex to assemble and/or integrate with an existing OEM outdrive unit.

Accordingly, there remains room for improvement in the field of outdrives for watercraft with inboard motors.

SUMMARY OF THE INVENTION

An outdrive for a marine vessel, such as a watercraft, is provided to move a propeller and its shaft relative to a watercraft bottom while the vessel is under power.

In one embodiment, the outdrive is joined with a watercraft having an inboard engine. The outdrive can include a standoff box having a transfer shaft that rotates in response to rotation of an input shaft coupled to the inboard engine. The drive unit can include a propeller shaft and an associated propeller that rotate in response to rotation of the transfer shaft. The drive unit is vertically movable relative to the standoff box.

In another embodiment, the standoff box can include one or more idler gears that move via a system of brackets relative to an input gear and a transfer gear to maintain rotational engagement between the input gear and the transfer gear, which is joined with the drive unit to rotate the propeller.

In still another embodiment, the input gear is joined with an input shaft extending from the engine of the vessel. The transfer gear is joined with a transfer shaft that is rotationally joined with a propeller shaft and propeller of the moveable drive unit. An idler shaft is rotatably disposed in the standoff box, and is moveable up and down with the drive unit, inside the standoff box, as the drive unit translates to and from the raised and lowered modes to maintain rotational translation between the input gear and transfer gear, and thus the propeller.

In yet another embodiment, a first idler gear is joined with the idler shaft and configured to engage the input gear, thereby imparting rotation from the input shaft to the idler shaft. A second idler gear is joined with the idler shaft distal from the first idler gear. The second idler gear is configured to rotate with the idler shaft. The transfer gear is engaged with the second idler gear such that rotation of the second idler gear is imparted to the transfer gear. The standoff box is configured to be joined with the drive unit having a propeller shaft rotatable upon rotation of the transfer shaft and a propeller joined with the propeller shaft. The drive unit is operable in a raised mode, in which the propeller shaft is disposed a first distance from the standoff box, and a lowered mode, in which the propeller shaft is disposed a second distance, greater than the first distance, from the standoff box. The standoff box with its gears provides constant transfer of forces and rotation from the input shaft to the propeller as the drive unit vertically translates from one mode to the other.

In even another embodiment, the standoff box can house multiple brackets that rotate relative to one another, the input shaft, the idler shaft and/or the transfer shaft. The brackets can include a proximal bracket adjacent the input gear and rotatable relative to the input gear, an idler bracket disposed adjacent and/or between the first idler gear and the second idler gear, the idler bracket fixedly joined with the proximal bracket so the proximal bracket and the idler bracket rotate in unison; and/or a distal bracket disposed adjacent the transfer gear, the distal bracket being rotatably mounted relative to the transfer shaft.

In a further embodiment, the standoff box can include a first guide element oriented relative to the transfer shaft at a fixed distance and a second guide element joined with the idler bracket. The first guide element can interface with the second guide element as the drive unit is lowered, so as to rotate the idler bracket about an input shaft axis. In so doing, the idler shaft remains a fixed distance from the transfer and input shafts, but moves along an arcuate path relative to those two axes. Optionally, the first guide element includes a pin and the second guide element includes a slot within which the pin is slidably disposed. The interaction of the pin and slot can guide the idler bracket and thus the idler gears along the arcuate path as the drive unit is raised or lowered. In turn, the idler gears maintain engagement with the input and transfer gears, even as they move inside the standoff box.

In yet a further embodiment, the first and second idler gears rotate about an idler gear axis. The input gear rotates about an input gear axis. The transfer gear rotates about a transfer gear axis. The input gear axis and the transfer gear axis move closer to one another when the drive unit is lowered, but the idler gear axis can remain at the constant, fixed distances from the input gear axis and from the transfer gear axis when viewed from a rear perspective.

In even a further embodiment, the drive unit is movable from a raised mode, in which the propeller shaft is a first distance from a reference line extending rearward from the transom, to a lowered mode, in which it is a second distance, greater than the first distance, from the reference line. This lowers a thrust point produced by the propeller, all while the watercraft is moving through water and while the propeller is producing thrust.

In a further embodiment, the drive unit moves relative to the standoff box so that in both the raised mode and the lowered mode, the propeller shaft is maintained at a fixed angle relative to a reference line projecting rearward from a bottom of a transom of the watercraft. In this manner, the propeller shaft generally does not tilt longitudinally relative to the reference line. Instead, the propeller shaft simply moves vertically, upward and downward, while maintaining a fixed spatial orientation relative to the transom and a reference line.

In even a further embodiment, a method of operating a watercraft with the standoff box is provided. The method can include: rotating an input shaft and an input gear in a standoff box; rotating a first idler gear joined with an idler shaft with the input gear; rotating a second idler gear joined with the idler shaft distal from the first idler gear; rotating a transfer gear engaged with the second idler gear and rotating a transfer shaft with the transfer gear. The first and second idler gears can rotate about an idler gear axis. The input gear can rotate about an input gear axis. The transfer gear can rotate about a transfer gear axis to subsequently rotate a propeller shaft of a drive unit. The input gear axis and the transfer gear axis can move closer to one another when viewed from a rear perspective, however, the idler gear axis simultaneously can remain at a fixed distance from the input gear axis and from the transfer gear axis, when the drive unit is lowered and/or raised and/or as the input and transfer gears move relative to one another.

The current embodiments of the marine outdrive and related methods herein provide benefits in watercraft propulsion that previously have been unachievable. For example, where the outdrive is utilized on watercraft, the adjustability of the drive unit relative to the standoff box vertically allows an operator to lower a thrust point of the propeller to gain leverage and lift the bow of the watercraft, to get on plane more quickly. The enabled vertical spacing adjustment of the outdrive can allow alteration of the thrust point of the propeller without disassembling or otherwise mechanically modifying the outdrive. In addition, when the watercraft is loaded with gear, payload and occupants, which alters the buoyancy of the watercraft, an operator can adjust the outdrive, even when the watercraft is under power and moving through the water, to ideally set the propeller shaft location. The operator also can adjust the outdrive depending on the amount of fuel in fuel tanks on the watercraft. Further, the standoff box with the associated idler gears, transfer gear and transfer shaft herein can be quickly and easily mounted as an aftermarket part to an existing watercraft drive system. The stock drive unit and stock transfer shaft also can be used, so that installation and assembly is relatively simple.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
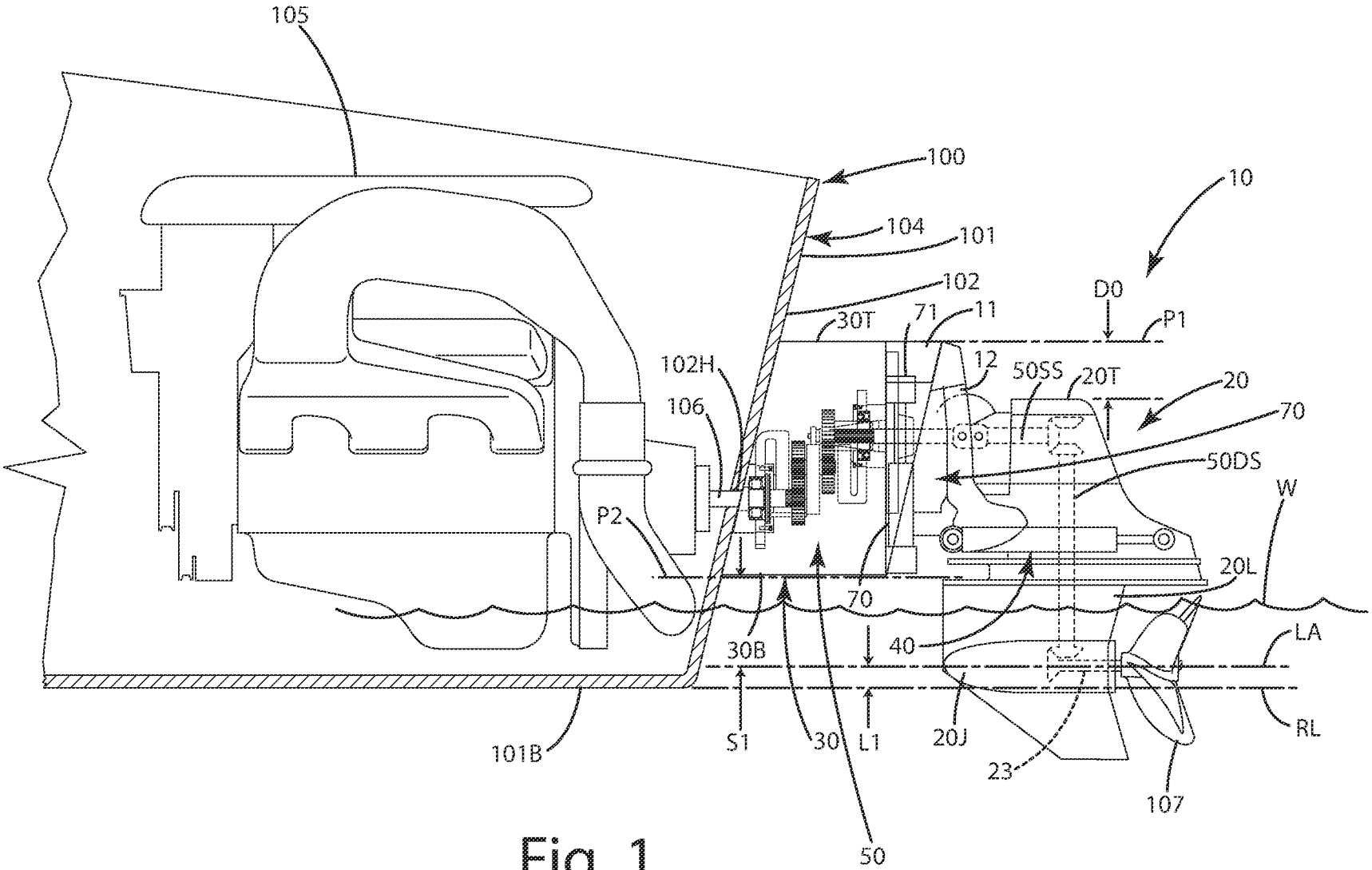
FIG. 1 is a side partial section view of a watercraft including a standoff box and drive unit of the current embodiment with the drive unit in a raised mode.

A current embodiment of the watercraft outdrive is illustrated in FIGS. 1-15, and generally designated 10. As illustrated in FIGS. 1-6, the outdrive 10 is joined with a watercraft 100. Although shown as a high performance boat, the watercraft 100 with which the outdrive 10 is used can be any type of marine vessel, for example, a recreational boat, a racing boat, a pontoon boat, a fishing vessel, a tanker or other type of commercial vessel, a submarine, a personal watercraft, an amphibious vehicle, an underwater exploration vehicle, or any other type of vessel that is propelled through or on water via a propeller.

The watercraft 100 includes a hull 101 having a stern 104 at which a transom 102 is located. The hull 101 also includes a bottom 101B. This bottom can coincide with or include a lowermost portion of the hull. The watercraft can include a reference line RL that extends rearward from the hull 101, and in particular, that extends from the lowermost portion of the transom 102 and/or bottom 101B, rearward from the boat. As used herein, this reference line RL is helpful in appreciating the spatial orientation of the propeller shaft 23, which includes its own longitudinal axis LA, relative to the lowermost portion of the transom and/or the bottom 101B of the watercraft.

Within the hull 101, an engine or motor 105 is disposed. With this configuration, the watercraft 100 is considered an inboard type of watercraft, where the engine is mounted inside the hull, rather than hanging off the back of the hull or otherwise disposed outside the hull. The engine is joined with an input shaft 106 that extends rearwardly from the engine and through a hole 102H in the transom 102. The hull hole 102H is sealed so that water cannot enter through the hole into the hull. A bearing (not shown) can be associated with the hull hole. The input shaft is rotated by the engine under force and generally is utilized to rotate the various components of the outdrive 10 and ultimately the propeller 107 as described below. Further, although referred to as an input shaft, this component can include multiple shafts or members connected to one another via different types of joints, such as universal joints. If there is more than one shaft connected to others, collectively, those shafts are still considered an input shaft.

The input shaft 106 extends rearward and is rotationally coupled to the components of the outdrive 10. Many components of the outdrive 10, as explained below, can be rotationally coupled to one another and directly or indirectly rotationally coupled to the input shaft 106. As used herein, rotatably coupled means that rotation of one element causes rotation of another element, regardless of whether the two elements are in direct contact with one another or have other elements therebetween, so that the two elements do not directly contact or engage one another during rotation.

The outdrive 10 can be mounted to the watercraft, and in particular, the transom 102. The outdrive 10 can include a drive unit 20 and a standoff box 30. The standoff box can interface directly with the transom 102 with a gasket or seal therebetween to prevent water from entering the input shaft hole 102H or other fastener holes used to connect the standoff box 30 to the transom 102. The standoff box 30 can include the various components described herein to rotatably couple the input shaft 106 to a driveshaft SODS of the drive unit 20. The drive unit 20 can be movably joined with the standoff box 30 via a mounting bracket 11. The mounting bracket 11 can be oriented to enable the input shaft 106 to extend between portions of it or through it and directly to the outdrive unit 20. The mounting bracket can be outfitted with an armature or gimbal ring 12. This armature or gimbal ring can form a portion of a tilt assembly 40 that can tilt the drive unit at various angles relative to the plane P2 of the reference line RL, similar to that described in U.S. Pat. Nos. 9,914,518; 9,919,782 and 10,207,785 to Woody, which are hereby incorporated by reference in their entirety.

In addition to the tilt assembly 40, the outdrive 10 of the current embodiment can include a drive assembly 50 and a vertical adjustment assembly 70. All of these components can operate in concert to enable an operator to raise and lower the drive unit 20 relative to the standoff box, components thereof, and/or relative to the reference line RL. More particularly, the outdrive of the current embodiment is constructed so that the drive unit 20 can be operable in a raised mode as shown in FIG. 1. There, the top 20T of the drive unit 20 is a vertical distance D0 from an upper surface or upper plane P1 of the standoff box 30. This distance D0 can be optionally 0, 1, 2, 3, 4, 5, 6 inches or increments thereof. Although illustrated with the top 20T below the upper surface of the standoff box, the top can in some cases and modes, be above the upper surface.

In this raised mode, the propeller shaft 23 and its longitudinal axis LA can be aligned in parallel to the reference line RL, particularly when the outdrive is in a neutral tilt position, as shown in FIG. 1. In some cases, the longitudinal axis LA can be generally parallel to a plane within which the reference line RL lies in this raised mode. In this case, the longitudinal axis LA is offset 0 inches from the reference line RL. In other cases, the longitudinal axis LA can be disposed a preselected distance L1, for example 0, 1, 2, 3, 4, 5, 6 inches or increments thereof above the reference line RL. Optionally, the longitudinal axis LA can be disposed a small preselected distance L1, for example 0, 1, 2, 3, 4, 5, 6 inches or increments thereof above the reference line RL in the raised mode shown in FIG. 1.

Optionally, when the outdrive is in the raised mode, the propeller shaft 23, and particularly its longitudinal axis LA, is disposed a first distance S1 (FIG. 1) from the standoff box, and in particular, from the plane P2 in which the lowermost portion of the standoff box lays. This first distance S1 can extend, for example 0, 1, 2, 3, 4, 5, 6, 7, 8, 9, 10, 11, 12, 24 inches or increments thereof, below the plane P2.

Figure 10:
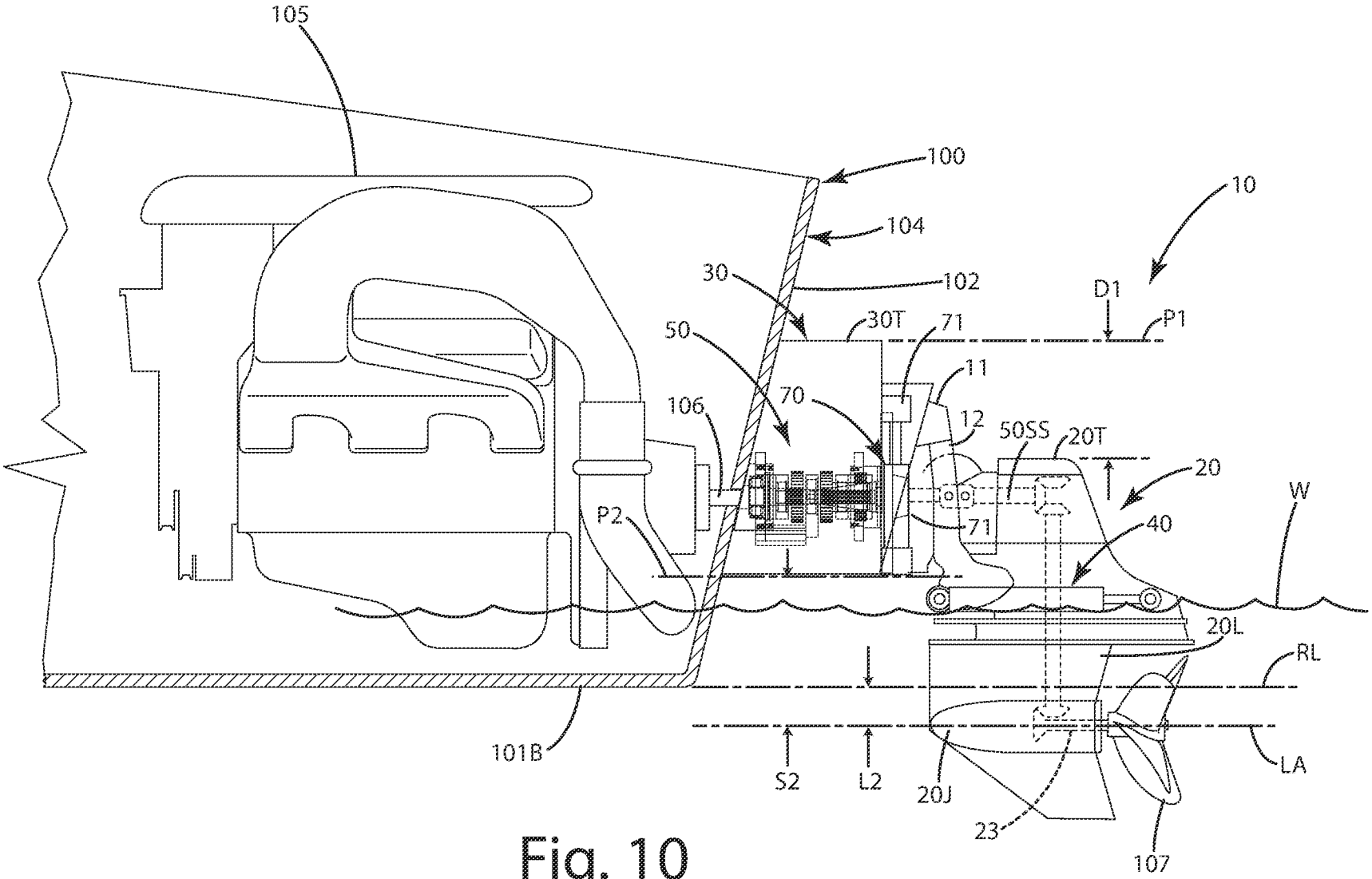
FIG. 10 is a side partial section view of the watercraft including the standoff box and drive unit of the current embodiment with the drive unit in a lowered mode.
Figure 11:
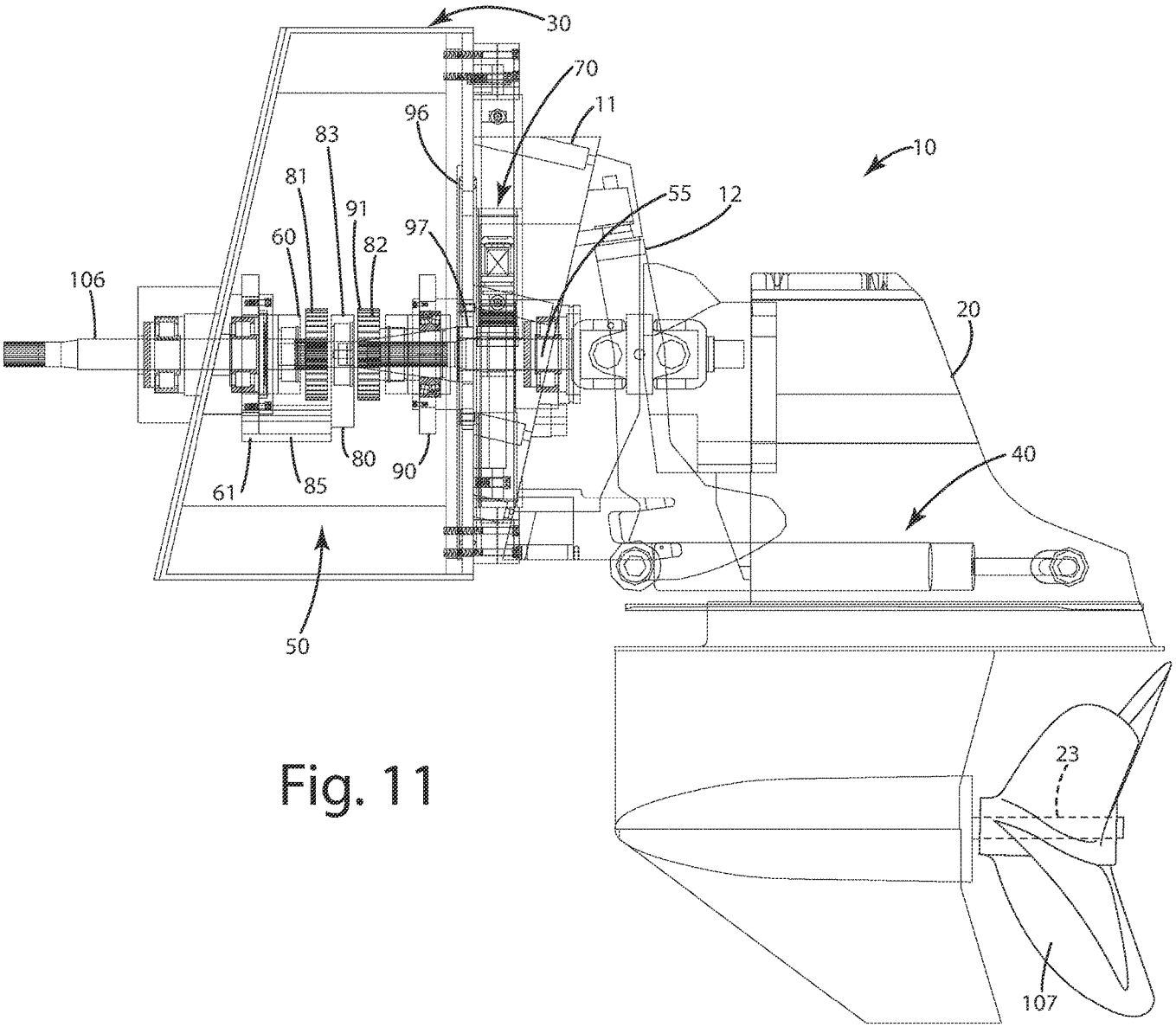
FIG. 11 is a side partial section view of the standoff box drive assembly with the drive unit in the lowered mode.

The drive unit 20 can be guided and urged with the vertical adjustment assembly 70 to a lowered mode as shown in FIG. 10. In this lowered mode, the top 20T of drive unit 20 moves downward relative to the upper wall 30T of the standoff box 30, and the plane P1 within which the uppermost portion of the standoff box and/or the upper wall lays, to a preselected distance D1. In effect, this distance D1 can be greater than D0. D1 can be optionally 0, 1, 2, 3, 4, 5, 6, 7, 8, 9, 10, 11, 12, 24 inches or increments thereof.

In this lowered mode, the propeller shaft 23 and its longitudinal axis LA can be aligned in parallel to the reference line RL, particularly when the outdrive is in a neutral tilt position, as shown in FIG. 10. In some cases, the longitudinal axis LA can be parallel to a plane within which the reference line RL lies in this lowered mode. In other cases, the longitudinal axis LA can be disposed a preselected distance L2, for example 0, 1, 2, 3, 4, 5, 6 inches or increments thereof below the reference line RL. Optionally, the longitudinal axis LA can be disposed a small preselected distance L2, for example 0, 1, 2, 3, 4, 5, 6 inches or increments thereof below the reference line RL in the lowered mode shown in FIG. 10.

Optionally, when the outdrive is in the lowered mode, the propeller shaft 23, and particularly its longitudinal axis LA, is disposed a second distance S2 (FIG. 10) from the standoff box, and in particular, from the plane P2 in which the lowermost portion of the standoff box plane P2 and/or lower wall 30B lays. This second distance S2 can be greater than the first distance S1, for example 1, 2, 3, 4, 5, 6 inches or increments thereof greater than the first distance S1.

The drive unit 20 of the outdrive 10 is movable from the raised mode to the lowered mode while the watercraft 100 is moving through a body of water W and while the propeller shaft 23 and the propeller 107 are spinning and producing thrust to propel the boat in a direction. The drive unit 20 is movable vertically upward and downward (as opposed to being tilted upward or tilted downward) while the watercraft is moving through a body of water and while the propeller shaft 23 and the propeller 107 are spinning and producing thrust. Further, the spatial offset of the longitudinal axis LA from the distance L1 to a second, different distance L2 (in transitioning from the raised mode to the lowered mode) can all occur while the watercraft is under power and the propeller is spinning.

The various components of the outdrive 10, for example, the drive unit 20, the standoff box 30 with the drive assembly 50 therein, and the vertical adjustment assembly 70 will now be described in more detail. As shown in the views of FIGS. 1 and 10, the outdrive 10 can include a drive unit 20, which can be a stock, bolt on drive unit that comes with the watercraft. The current embodiment of the outdrive 10 allows that stock or OEM drive unit 20 (or some aftermarket unit) to be removed from the watercraft, and the standoff box 30, drive assembly 50 and vertical adjustment assembly 70 installed between it and the watercraft, without significantly altering the drive unit 20. That drive unit 20 can include a secondary shaft 50SS joined with a transfer shaft 55 that extends into the standoff box as described below. The drive unit can include a driveshaft SODS an upper or top surface 20T which can generally form the uppermost portion of the housing near plane P1. The drive unit 20 can include a lower portion 20L having a bullet or torpedo 20J that houses the propeller shaft 23 that is coupled to the driveshaft SODS. The drive unit 20 can also include the propeller 107 which is fixedly and non-rotatably joined with the propeller shaft 23.

With reference to FIGS. 1 and 10, the components and operation of the vertical adjustment assembly 70 will be briefly described. That vertical adjustment assembly 70 can move the drive unit vertically, and generally relative to the standoff box 30. Depending on the particular application, the various components of the vertical adjustment assembly can be joined with the mounting bracket 11 and the standoff box 30 respectively, and can include first and second actuators 71, which can be in the form of hydraulic, pneumatic or other types of cylinders with rams that extend and retract relative to a main body or cylinder. The actuators 71 can be in a common fluid or hydraulic circuit so that the actuators simultaneously, consistently and evenly engage the mounting bracket 11 to which they are joined to move it and the drive unit 20, along with all of its components, in an even and level manner upward and downward to and from the various modes. Opposing ends of the actuators can be joined directly to the standoff box 30 to provide movement of the drive unit relative to the standoff box.

As mentioned above, the outdrive 10 includes a drive assembly 50. Many components of the drive assembly 50 are disposed in or otherwise joined with the standoff box 30. The standoff box 30 can be in the form of an enclosed box or housing including an upper top wall 30T, an opposing lower or bottom wall 30B, and other various walls. The standoff box 30 can be sealably installed and fixed immovably to the transom 102 or the hull. With reference to FIGS. 1-15, the drive assembly 50 includes multiple shafts, gears and brackets that are fixedly and/or rotationally coupled to one another.

The drive assembly 50 and its components are rotated via the input shaft 106 that extends through the transom 102 of the watercraft 100 and ultimately to the engine 105 within the hull of the watercraft. In many applications, the input shaft 106 is constantly spinning, as soon as the engine is started. The input shaft 106 can be configured in a substantially horizontal orientation, and can extend through the transom 102 of the boat 100, through the front or transom facing wall of the standoff box 30 and into the interior of the standoff box 30. The input shaft can be rotatably mounted relative to a thrust bearing 106G. The input shaft can extend through a base hub 106B, which is fixedly mounted to the standoff box 30. The input shaft can be associated with a keeper 106K that constrains a shaft flange 106F of the shaft 106.

An input gear 60 can be joined with the input shaft 106, and rotationally fixed thereto with splines or other elements so the shaft and input gear rotate in unison about an input gear axis IGA. Generally, the input shaft and the input gear can remain in a fixed location and orientation in the standoff box 30. Those elements can rotate in the standoff box, but generally do not change position or spatial orientation within the standoff box. Generally, the input gear 60 can engage a first idler gear 81 of the drive assembly to impart rotation from the input shaft 106 to the idler shaft 84 as described below.

The drive assembly 50 can include a proximal idler bracket 61, also referred to as a proximal bracket, adjacent the input gear 60. The proximal bracket 61 can include a first plate 62 and a second plate 63 that are connected via a bridge 64. The first plate 62 and second plate 63 can be spaced from one another a distance D3 so that the plates are offset and spaced from one another along the input gear axis IGA. The first plate 62 can include a first bore or hole 620. This hole 620 can be sized so that the input shaft 106 can fit through it. The first plate 62 also can define one or more fastener holes 62H which can be configured to receive fasteners that secure that plate fixedly and non-rotationally relative to an intermediate idler bracket 80, also referred to as an idler bracket as described below. With this construction and attachment, the proximal bracket 61 and the idler bracket 80 rotate in unison and are fixedly secured to one another.

The drive assembly 50 as mentioned above also can include the noted idler bracket 80. This idler bracket 80 can be disposed rearwardly of the input gear 60 and the input shaft 106. As shown in FIG. 14A, the idler bracket 80 can include an idler shaft hole 80H that is defined in a primary plate 83. That idler shaft hole can be sized to accommodate an idler shaft 84 to which the first 81 and second 82 idler gears can be fixedly and nonrotatably mounted. The primary plate 83 can be attached to a leg 85 defining multiple fastener holes 85H. This leg 85 can be fastened otherwise secured to the proximal bracket 61. Fasteners can be secured through the fastener holes 62H and 85H of the respective proximal bracket and idler bracket. With this securement, these two brackets can rotate in unison generally about the input gear axis IGA as described more below.

Figure 5:
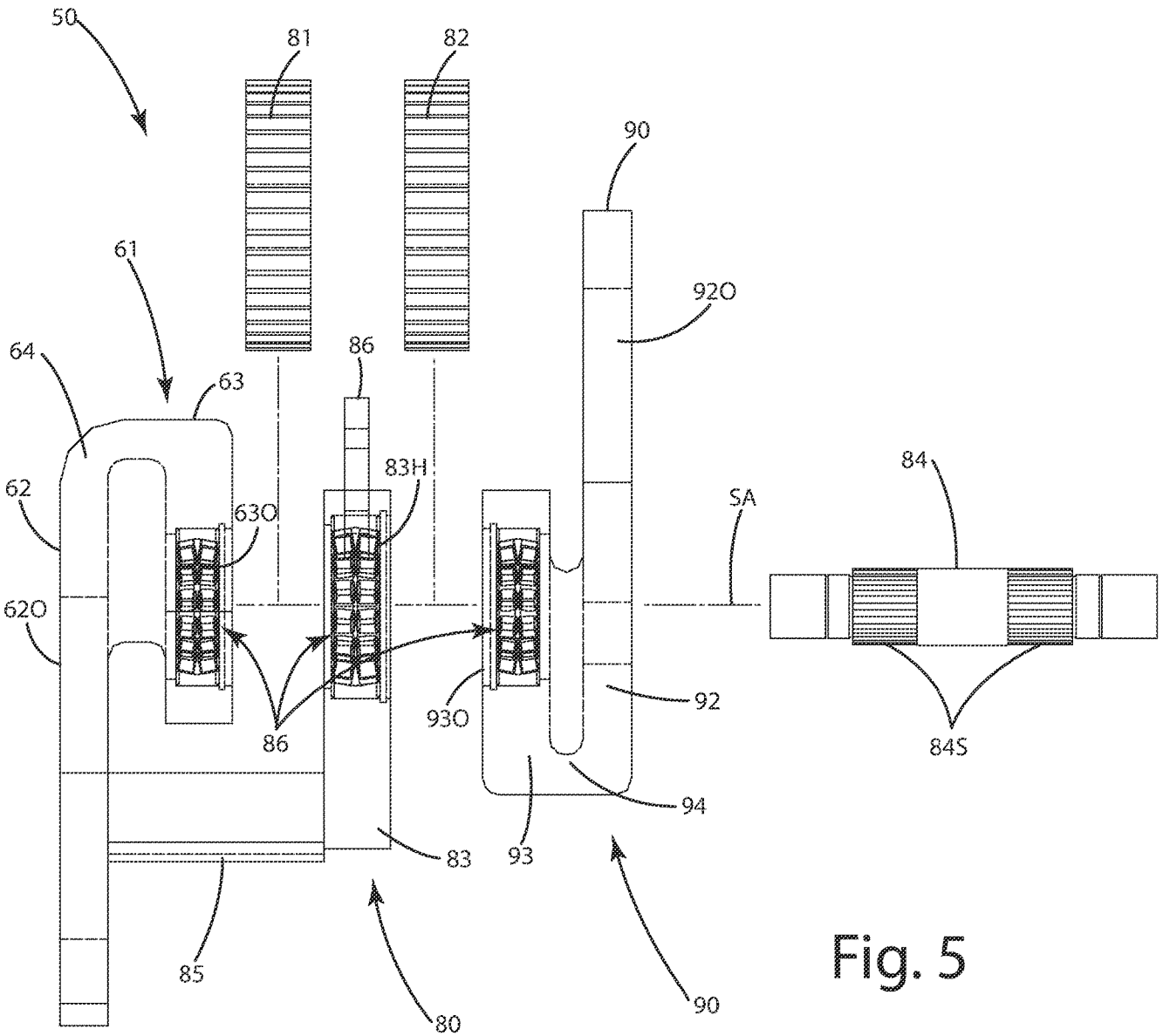
FIG. 5 is a side exploded view of the various brackets and the idler gears with the idler shaft.

The idler shaft 84 can be rotatably mounted in the standoff box and more particularly rotates relative to the proximal bracket 61 and the idler bracket 80, as well as the distal bracket 90 described below. As shown in FIG. 5, the idler shaft 84 can be mounted in bearings 86 that are associated with each of the respective proximal bracket, idler bracket and distal bracket 90. The idler shaft 84 can include splines 84S that mate with corresponding splines of the first idler year 81 and the second idler gear 82. Each of the respective first and second idler gears 81 and 82 configured to rotate in unison with the idler shaft 84, generally about the idler gear axis SA.

Each of the respective first and second idler gears 81 and 82 can be mounted on the idler shaft 84 located between respective brackets. For example, as shown in FIG. 5, the first idler gear 81 can be mounted between the proximal bracket 61 and the intermediate idler bracket 80. The second idler gear 82 can be mounted between the idler bracket 80 and the distal bracket 90. The first idler gear 81 can be mounted on the input shaft between the second plate 63 of the proximal bracket 61, and the primary plate 83 of the idler bracket 80. The second idler gear 82 can be mounted between the primary plate 83 of the idler bracket 80 and the second plate 93 of the distal bracket 90. The idler shaft can extend through the holes 630, 83H and 930 of the respective proximal bracket, idler bracket, and distal bracket. Each of these holes can include a set of bearings 86 to facilitate rotation of the idler shaft 84. As mentioned above, the first idler gear 81 can mesh with and engage the input gear 60 so as to impart rotation from the input shaft 106 to the idler shaft 84.

Figure 12:
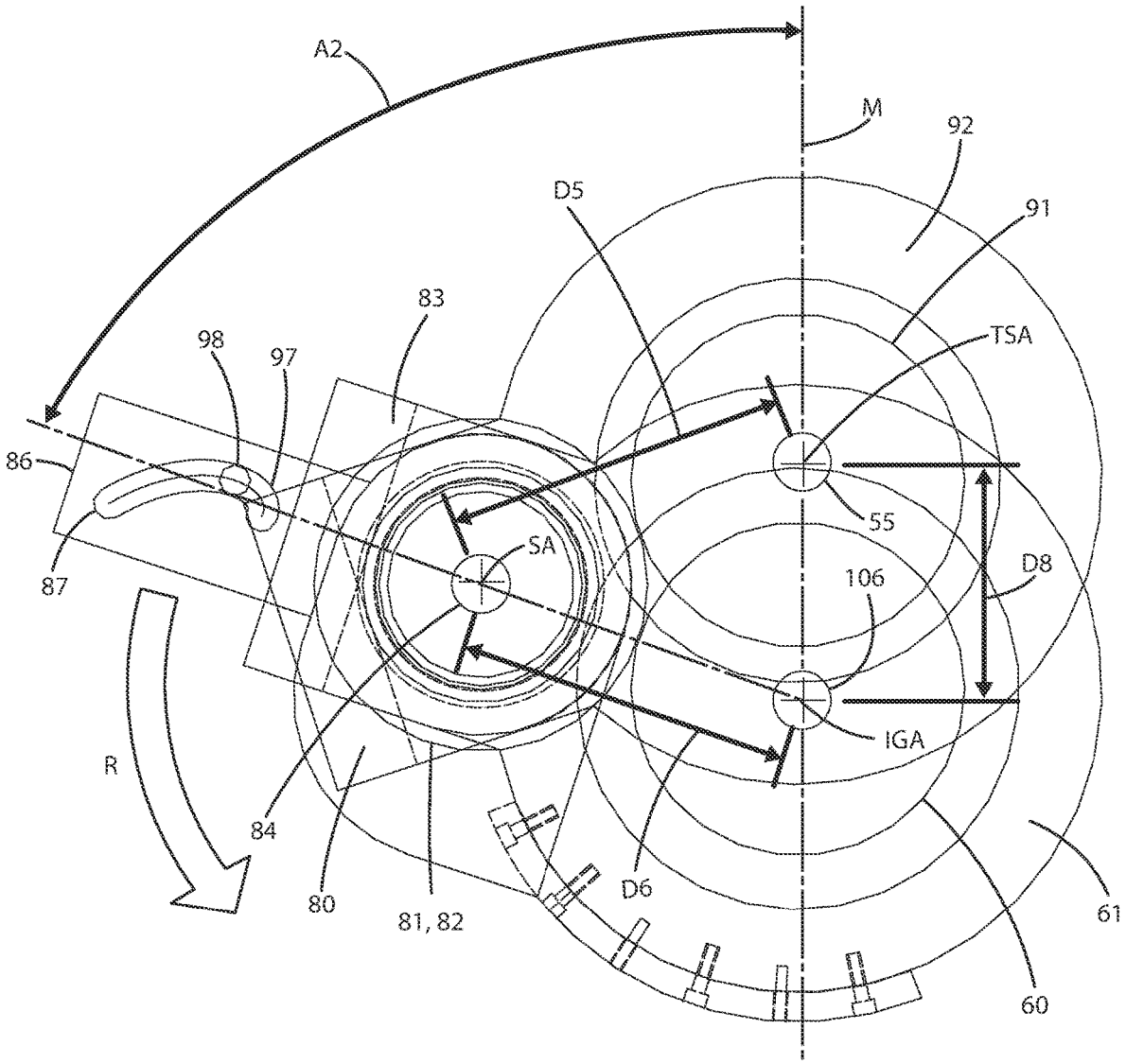
FIG. 12 is an end view of idler gears on an idler bracket engaging an input gear associated with a proximal bracket and a transfer gear associated with a distal bracket, the transfer gear configured to be associated with a transfer shaft of the drive unit, with the drive unit transitioning to the lowered mode.
Figure 13:
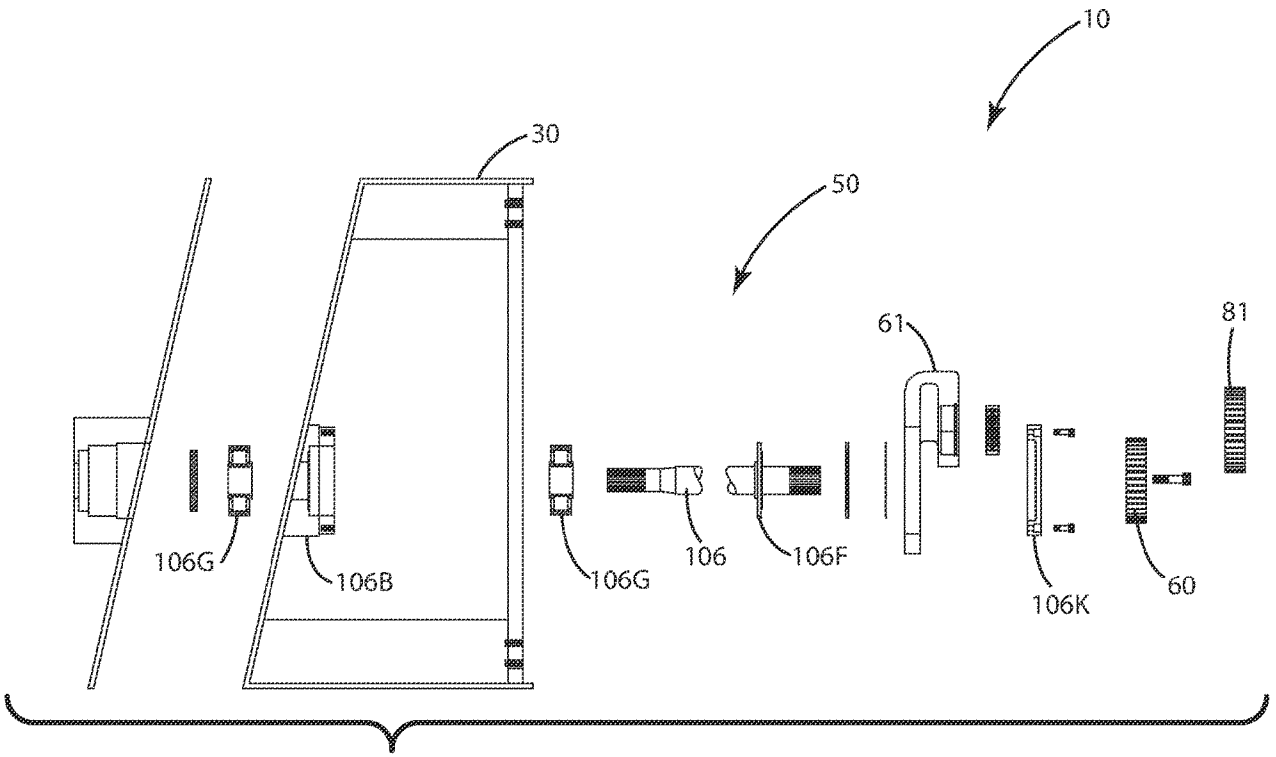
FIG. 13 is a first part of an exploded view of the standoff box, input shaft, proximal bracket, input gear and a first idler gear.
Figure 13A:
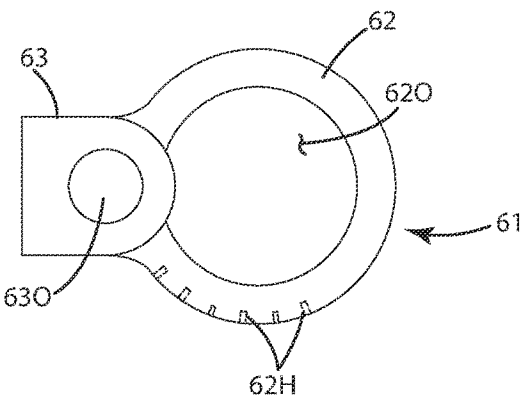
FIG. 13A is an end view of the proximal bracket.
Figure 14:
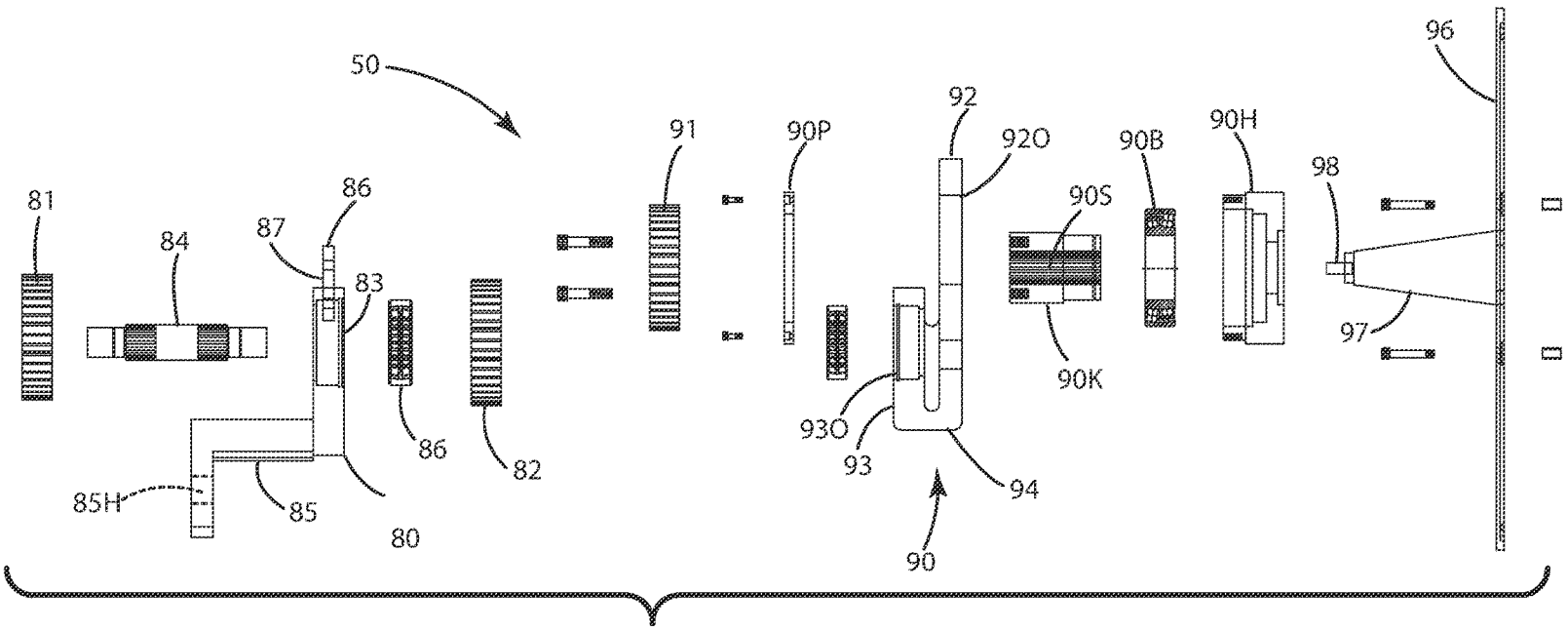
FIG. 14 is a second part of the exploded view continued from the right of FIG. 13 including a second idler gear, an idler shaft, an idler bracket, a transfer gear, a distal bracket, a hub and a guide element or pin associated with a moveable plate.
Figure 14A:
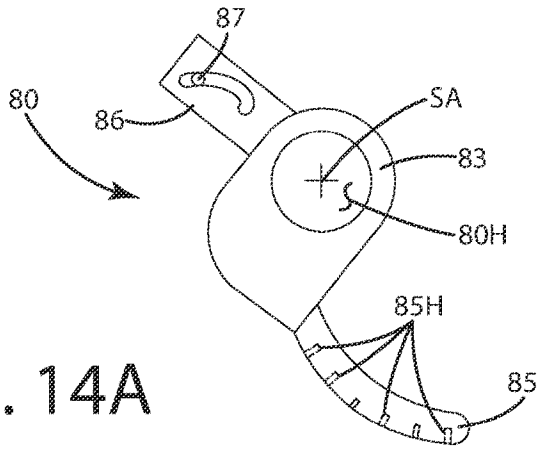
FIG. 14A is an end view of the idler bracket.

As shown in FIGS. 14 and 14A, the idler bracket 80 can include a guide element 86 joined with the primary plate 83. This guide element 86, sometimes referred to as a second guide element, can define a slot 87. The slot can have a rounded and/or an arcuate shape as shown in FIGS. 12 and 14A. The arcuate shape can be clocked or timed such that the idler shaft and associated idler gears move along an arcuate path when raising and/or lowering the drive unit as described further below. The guide element 86 can be in the form of a tab or an ear that extends upwardly and away from the plate 83 as shown. This second guide element 86 can generally be disposed between the first idler gear 81 and the second idler gear 82 when the drive assembly is in use. Generally, this guide element 86 remains at a fixed distance from the idler shaft axis SA. The guide element 86, does however rotate about the shaft axis SA when raising and lowering the drive unit 20 as described below.

As mentioned above, and shown in FIGS. 2 and 4, the drive assembly 50 can include a transfer gear 91 that is engaged with the second idler gear 82. When the second idler gear 82 rotates, that rotation is imparted to the transfer gear 91 so that it rotates, along with the transfer shaft 55 to which it is bound. Generally, the transfer gear 91 is aligned with the idler gear 82 at all times during raising and lowering of the drive unit 20. These two gears also mesh engage one another so as to transfer rotation from the input shaft 106 to the idler shaft 84 ultimately to the transfer shaft 55 and thus the eventually the drive unit and the propeller.

Figure 15A:
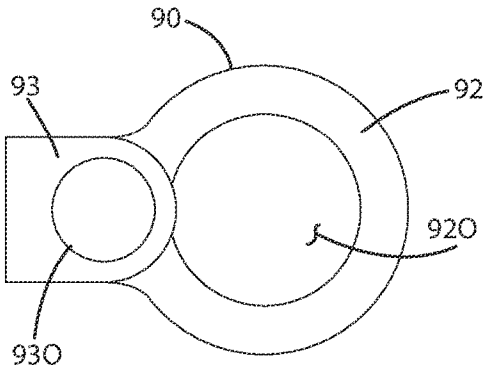
FIG. 15A is an end view of the distal bracket.

The drive assembly also can include a distal bracket 90 that is disposed adjacent the transfer gear 91. This distal bracket 90 can include, as shown in FIG. 15A, a first plate 92 that defines a hole or opening 920 through which the transfer shaft 55 and optionally the transfer gear 91 can fit. The first plate 92 can be joined via a bridge 94 to the second plate 93. The second plate 93 can include a second hole 930 through which the idler shaft 84 fits and is rotationally constrained as mentioned above.

Figure 2:
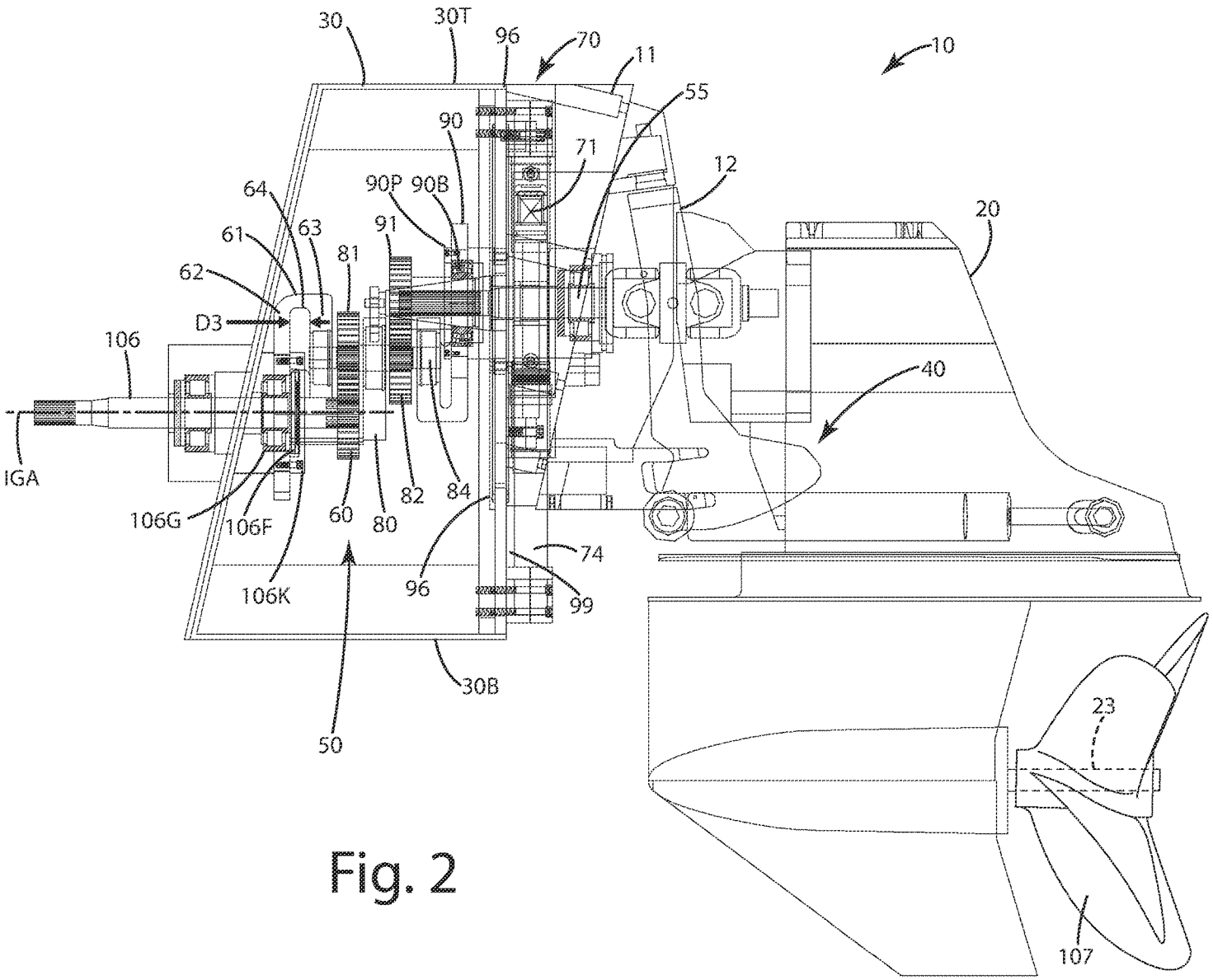
FIG. 2 is a side partial section view of the standoff box drive assembly with the drive unit in the raised mode.

As shown in FIGS. 2 and 14, the distal bracket 90 can be rotatably mounted to an adjuster plate 96 that is disposed at the rearward portion of the standoff box 30. In particular, a hub 90H can be secured fixedly to an adjuster plate 96 via fasteners or a weldment. A bearing set 90B can be disposed inside the hub 90H. Keeper plate 90P can secure the distal bracket 90 directly to the hub 90H such that the distal bracket 90 is rotatable about the transfer shaft axis TA. In this manner, the distal bracket 90 can freely rotate on the hub and relative to the adjuster plate 96, generally as the drive unit is raised and/or lowered as described below.

Figure 15:
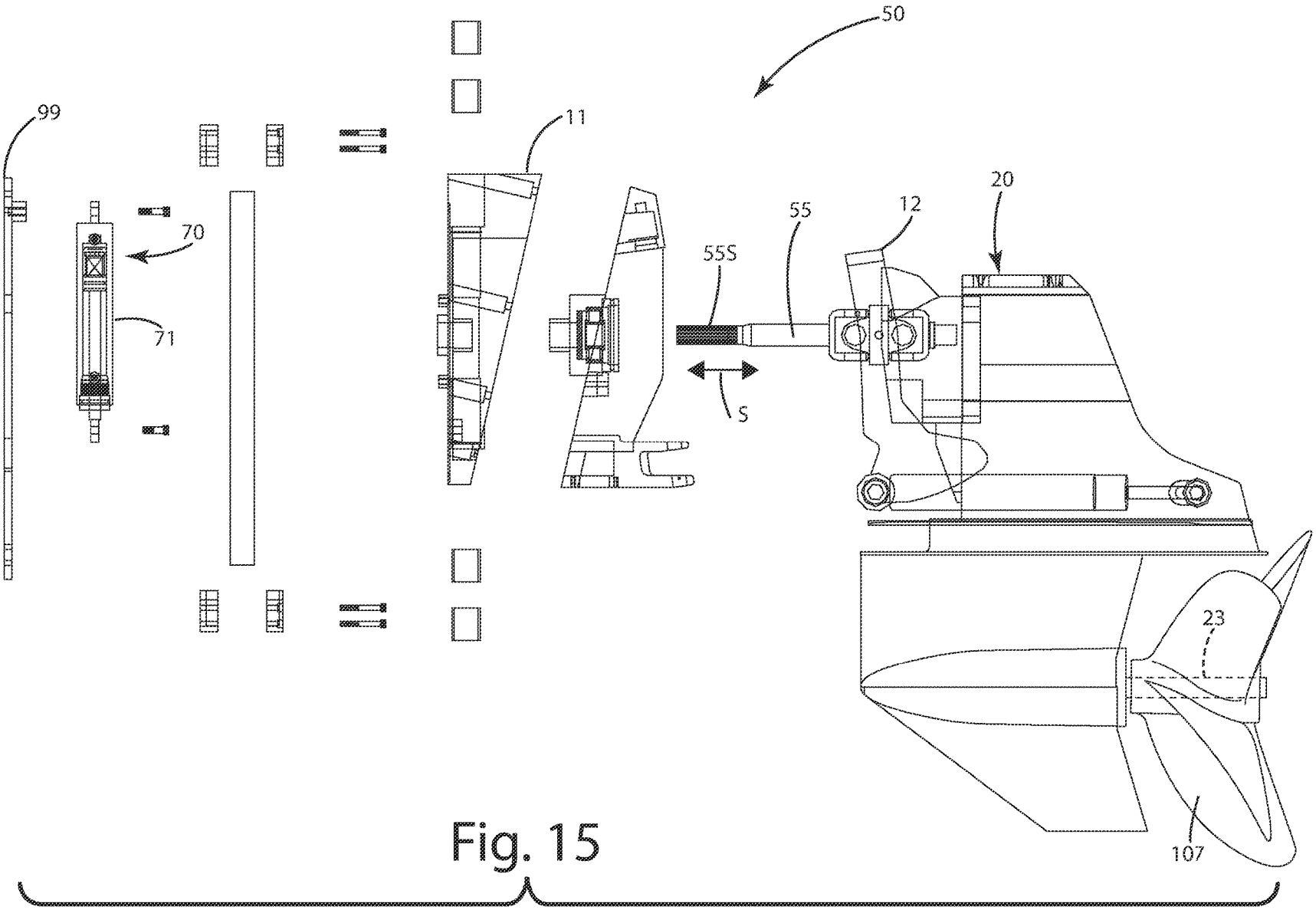
FIG. 15 is third part of the exploded view continued from the right of FIG. 14 including a rear wall of the standoff box, a drive mount, a transfer shaft and a stock drive unit.

Optionally, the transfer gear 91 is secured to a sleeve 90K which is further rotatably mounted relative to the distal bracket 90 and mounted inside the bearing set 90B. The transfer gear 91 and sleeve 90K thus can freely rotate relative to the hub 90H and the adjuster plate 96. The sleeve 90K can include a splined hole 90S. The splines can mate with the splines 55S of the transfer shaft 55 as shown in FIG. 15. The interface of the splines 55S of the transfer shaft 55 in the splined hole 90S in the sleeve 90K can allow the shaft to move and slide longitudinally in direction S within the sleeve. Thus, the transfer shaft 55 can move linearly relative to and/or through the adjuster plate 96 when the drive unit 20 shifts or moves. This extra play can allow slight linear movement of the transfer shaft relative to the drive assembly.

The drive assembly 50 also can include a guide element 97. This guide element 97, also referred to as the first guide element, can include a pin 98. This pin 98 can fit within and can directly engage the guide element 86 of the idler bracket 80. In particular, the pin 98 can be slidably disposed in the slot 87 of the tab 86 associated with the idler bracket 80. Generally, the pin 98 moves and/or slides within the slot 87 as the drive unit 20 is raised or lowered via the vertical adjustment assembly 70. In turn, this pin and its movement can move the ear and the attached idler bracket, and associated idler gears so that they maintain engagement with the respective input gear and transfer gear.

As shown in FIGS. 2, 14 and 15, the adjuster plate 96 can be fastened and secured to wedge 11 and gimbal ring 12. Generally, the adjuster plate 96 can be movable up and down inside the standoff box 30, relative to its rear wall 99, when the drive unit 20 moves from the raised mode to the lowered mode and vice versa. Again, this action can be facilitated via the actuator 71 of the vertical adjustment assembly 70.

A method of operation of the outdrive 10 when raising and lowering the drive unit 20 will be described in connection with FIGS. 1-12. As mentioned above, the input shaft 106 can impart rotation to the input gear 60 which in turn engages the first idler gear 81 and rotates it. This in turn rotates the idler shaft 84 which is secured to the second idler gear 82. The second idler gear 82 is joined with the idler shaft distal from the first idler gear. The second idler gear 82 also engages the transfer gear 91. Transfer gear 91 is rotationally fixed relative to the transfer shaft 55, which again extends through the drive unit 20 and his rotationally coupled to the propeller shaft 23 and the propeller 107. Rotation of the input shaft 106 thus rotates the propeller 107 to propel the watercraft to produce thrust.

The current embodiment of the outdrive 10 allows a user to manipulate the drive assembly within the standoff box via the vertical adjustment assembly 70 while maintaining power to the propeller 107 via the input shaft 106 from the engine of the watercraft, while the watercraft is moving under power in water. Generally, the drive unit is operable in a raised mode, shown in FIGS. 1-4 and 6, in which the propeller shaft is disposed a first distance from the standoff box, and in a lowered mode, shown in FIGS. 9-11, in which the propeller shaft is disposed a second distance, greater than the first distance, from the standoff box. In the raised mode of the drive unit 20 shown in FIGS. 1-4 and 6, the drive assembly and its components are oriented as shown. For example, the transfer gear 91 and transfer shaft 55 are disposed generally vertically above the input shaft 106 and the input gear 60. The associated distal bracket 92 also is generally above the proximal bracket 61. The idler gears 81 and 82, as well as the idler shaft 84, however are off set but remain engaged with the respective input gear and transfer gear. In particular, the first idler gear 81 remains engaged with the input gear 60, and the second idler gear 82 remains engaged with the transfer gear 91. Thus rotation of the input gear, rotates the first idler gear, which rotates the second idler gear, which rotates transfer gear, which indirectly rotates the transfer shaft and ultimately the propeller. This rotation can occur while the drive unit is in the raised mode as shown in FIGS. 1 and 2.

Figure 3:
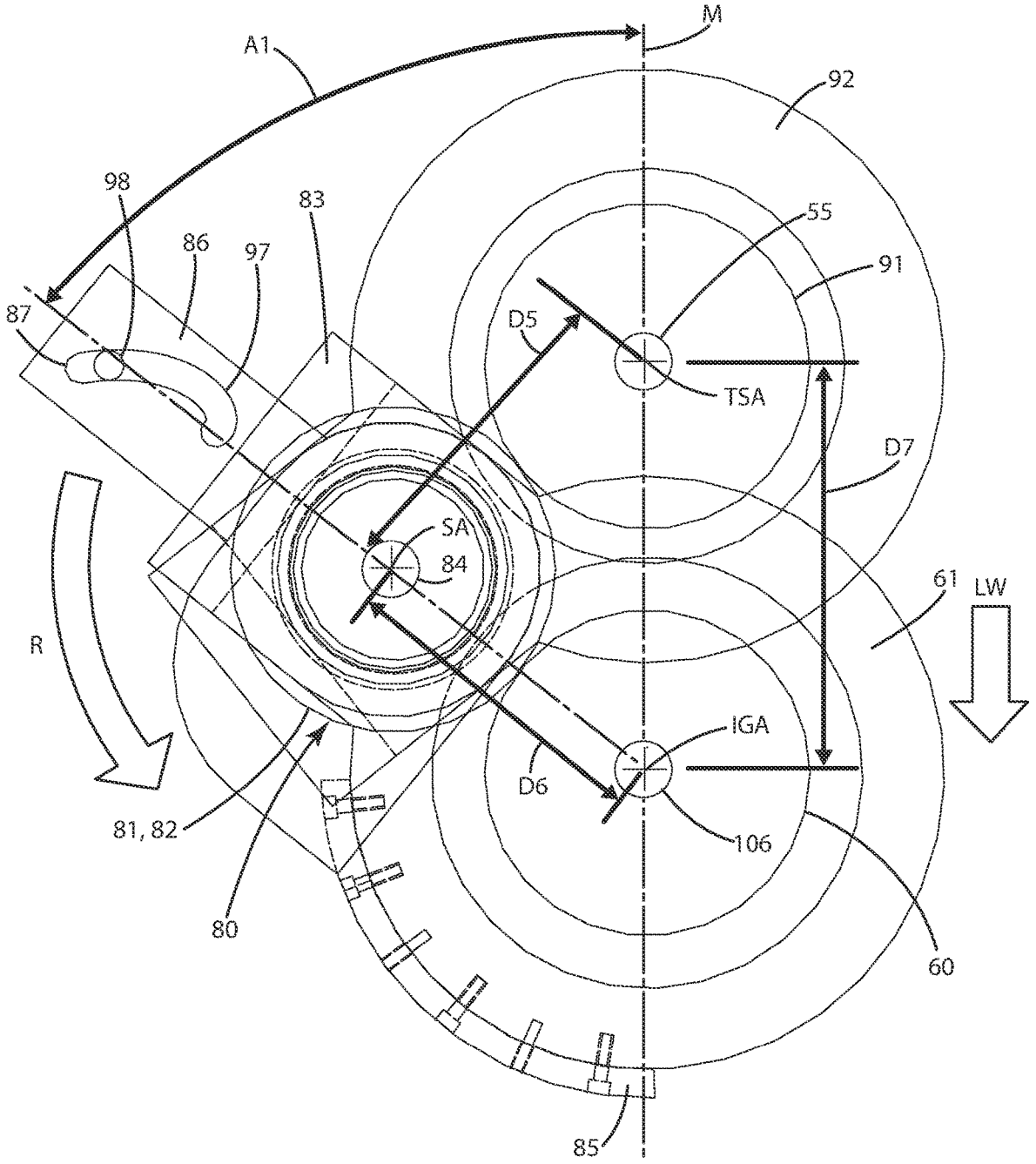
FIG. 3 is an end view of idler gears on an idler bracket engaging an input gear associated with a proximal bracket and a transfer gear associated with a distal bracket, the transfer gear configured to be associated with a transfer shaft of the drive unit, with the drive unit in the raised mode.
Figure 4:
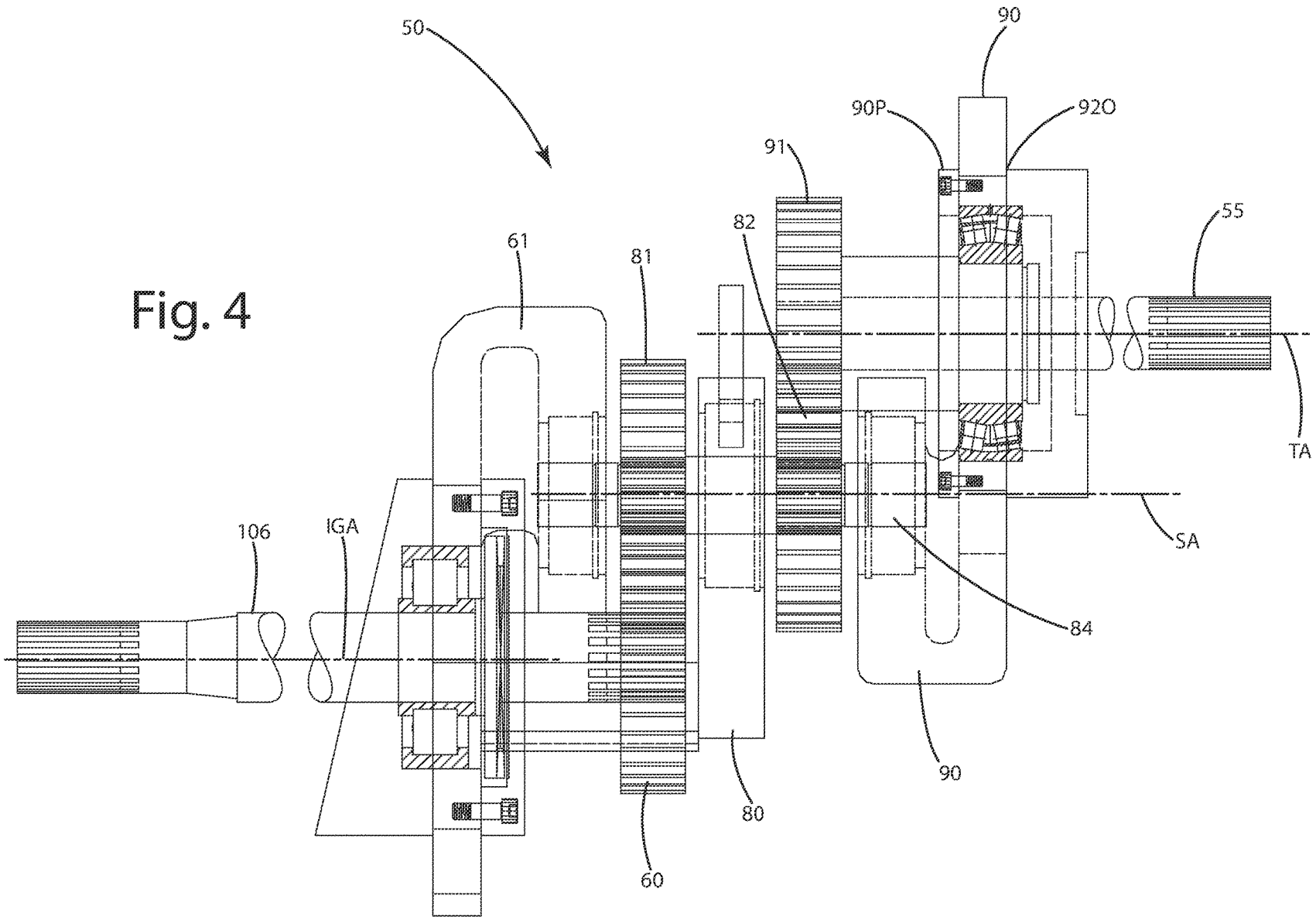
FIG. 4 is a simplified side view of an input shaft, input gear, proximal bracket, idler gears, idler bracket, transfer gear, transfer bracket and transfer shaft.
Figure 6:
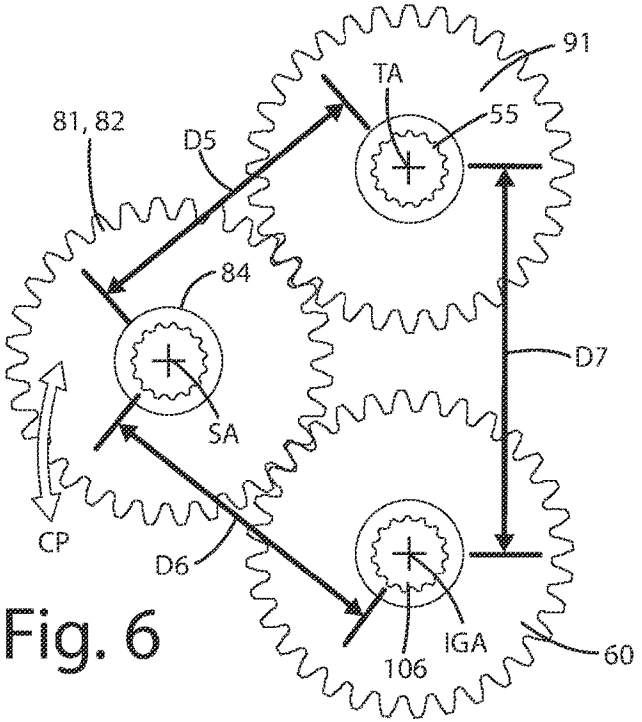
FIGS. 6-9 show a simplified transition of the idler gears relative to the input gear and the transfer gear as the drive unit translates from a raised mode represented in FIG. 6 to a lowered mode represented in FIG. 9.

In this raised mode of the drive unit 20, the axes of the respective gears and shafts can be maintained in particular distances relative to one another. For example, as shown in FIGS. 3 and 6, the distance between the idler shaft axis SA and the input shaft axis IGA is a distance D6. This distance can be established and fixed by the proximal idler bracket 61 and can be referred to as the proximal offset distance. The distance between the idler shaft axis SA and the transfer shaft axis TSA is a distance D5. This distance can be established and fixed by the distal idler bracket 92 and can be referred to as the distal offset distance. These two distances D5 and D6 can be equal. Further, these distances can be maintained and constant throughout the movement of the drive unit 20 from the raised mode to a lower mode and vice versa as well as all positions there between. The distance in the raised mode between the transfer shaft axis TSA and the input shaft axis IGA can be a distance D7. This distance D7, however can change as the drive unit 20 moves through various positions from the raised mode to the lowered mode, and vice versa.

In the raised mode, shown in FIGS. 3 and 6, the proximal bracket 61 can be disposed below the distal bracket 92. The intermediate idler bracket 80 is disposed generally between the two brackets, and more specifically between the two shafts 106 and 55. The primary plate 83 of the idler bracket also extends outwardly generally laterally relative to a vertical or other reference line M that passes through the transfer shaft axis TSA and the input shaft axis IGA. The guide element 86 is also disposed at an angle A1 relative to the line M. The guide element 97, optionally in the form of a pin 98, engages the other guide element 86, optionally in the form of an ear, and in particular, is disposed within the slot 87 of the ear. The pin 98 also can hold or maintain the idler bracket 80 in the position shown in the raised mode due to its securement to the adjuster plate 96 and the drive unit 20. Thus, the idler bracket 80 can remain in the position and angular orientation shown in FIG. 3 as the various gears and shafts ultimately rotate to the lowered and raised modes.

To transition from the above noted raised mode to the lowered mode shown in FIGS. 1-11, the vertical adjustment assembly 70 can be controlled by a user or a system. As a result, the actuator 71 moves the drive unit 20 downward as described above to change the orientation of the thrust point and propeller relative to the reference line of the watercraft. As the drive unit 20 moves down, the adjuster plate 96 also moves down. When the adjuster plate 96 moves down, due to its connection with the guide element 97 and for example the pin 98, that pin moves in a direction that is parallel to reference line M, optionally in a vertical plane. The pin, being received in the slot 87 of the ear 86 associated with the idler bracket 80, rotates that idler bracket 80 in direction R along an arcuate path. As shown in FIG. 3, the transfer shaft 55, transfer shaft axis TSA and generally the transfer gear 91 moves downward in direction LW toward the input shaft axis IGA, input gear 60 and input shaft 106. The angle A1 also increases.

More particularly, as shown in FIG. 12, as the drive unit 20 is lowered, the transfer shaft 55 and transfer gear 91 also are lowered, moving downward toward the input axis IGA of the input shaft 106. The distance thus between the transfer shaft axis TSA and the input shaft axis IGA decreases from distance D7 to a lesser distance D8. The distances between the idler shaft axis SA and the transfer shaft axis TSA, D5, and the idler shaft axis SA and the input shaft axis IGA, D6, respectively, remain the same fixed distances. Accordingly, each of the idler gears 81 and 82 remain engaged with the input gear 60 and the transfer gear 91. As these components are lowered, the proximal bracket, idler bracket, and distal bracket change in relationship to one another, while maintaining the distances D5 in D6 the same.

Movement of the brackets and the gears in the drive assembly 50, as the drive unit 20 is lowered, is provided via the interaction of the guide elements 97 and 87. In particular, the as mentioned above, the guide element 97, in the form of a post and/or a pin, projects from the adjuster plate 96. When the adjuster plate moves downward, via its attachment to the drive unit 20 and movement thereof by the vertical adjustment assembly 70, the pin 98 engages the slot 87 of the ear 86 of the idler bracket 80. As shown in FIGS. 3 and 12, as a result, the pin moves in a direction parallel to reference line M but is still constrained within the slot of the idler bracket, and the ear is rotated downward in direction R. This causes the idler bracket 82 move downward. The idler shaft 84 and the associated idler gears 81 and 82 thus also move downward in direction R along an arcuate path. While moving along this arcuate path, the idler gears 81 and 82 remain engaged with and mesh with the input gear 60 and the transfer gear 91. The angle A1 shown in FIG. 3 also increases to a greater angle A2 shown in FIG. 12 relative to the reference line M that passes through the input gear axis and the transfer gear axis.

Figure 7:
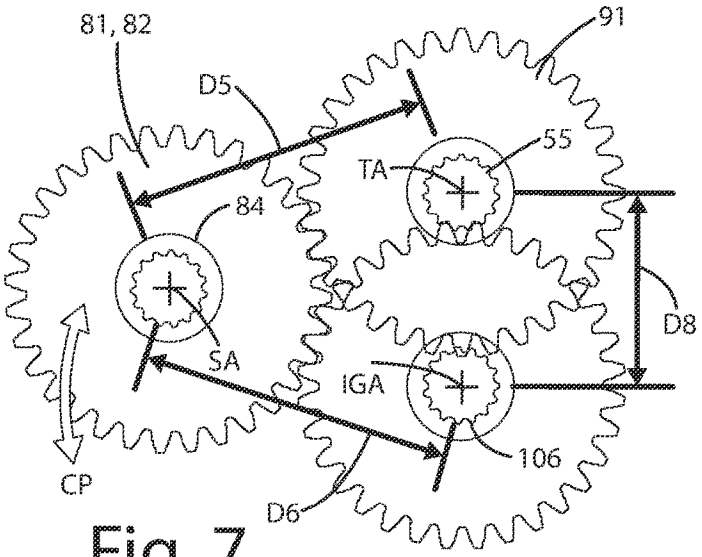
Figure 8:
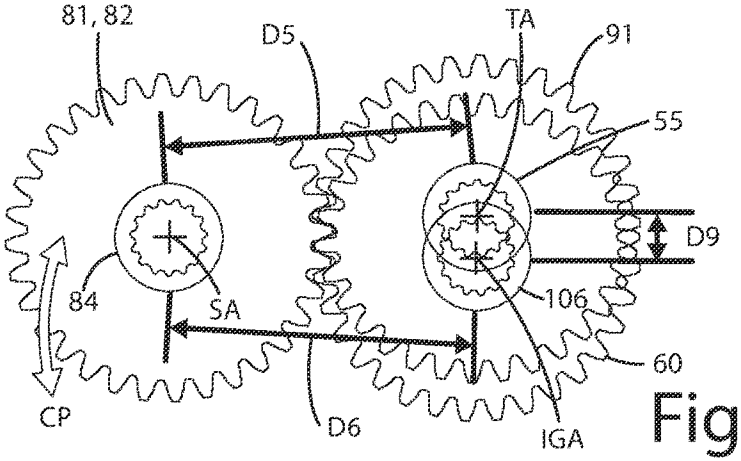
Figure 9:
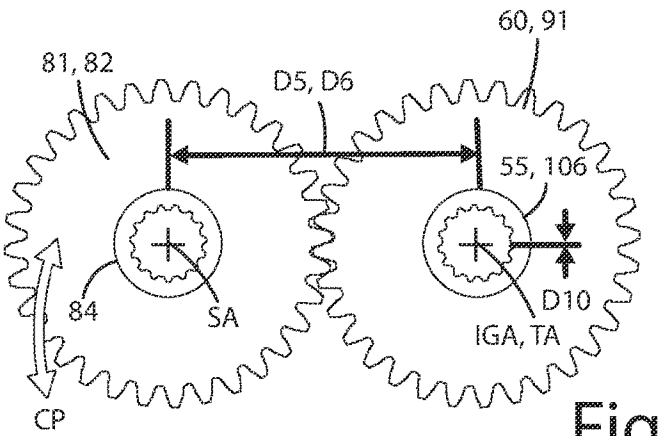

Simplified representations of the movement of the input gear 60, idler gears 81, 82 and transfer gear 91 are shown in FIGS. 6-9. These figures generally illustrate the transition of the respective gears as the drive unit 20 is lowered from a raised mode shown in FIG. 6 to a lowered mode shown in FIG. 9. In particular, FIG. 6 shows the gears when the drive unit is in a raised mode. There, the transfer gear 91 is located vertically above the input gear 60. The transfer axis TA is also located a distance D7 above the input gear axis IGA. The idler gear axis SA however is offset from the transfer axis TA by distance D5, and from the input gear axis IGA a distance D6. As the drive unit 20 is lowered, the respective brackets are moved downward with the adjuster plate 96. As this occurs, the transfer gear 91 moves down as shown in FIGS. 7-8. As a result, the distance between the transfer axis TA and the input gear axis IGA reduces from distance D8 to D9, which both are less than the original distance D7 between those elements in the raised mode. The distances D5 and D6, however remain the same so that the respective idler gears 81, 82 maintain contact with and rotate with the respective input gear 60 and transfer gear 91.

When the drive unit 20 is lowered to its lowermost extent, the input gear axis IGA and the transfer axis TA can be aligned and coincident with one another. The distance D10 between those axes can be almost or equal to zero. The respective distances between those axes and the idler axis SA, however are maintained at the constant, unchanging distances D5, D6. This can occur even as the idler shaft 84, the idler axis SA and the idler gears 81 and 82 move along the curvilinear path CP from the raised mode to the lowered mode and vice versa. Again, the idler gears 81, 82 maintain engagement with the input gear 60 and transfer gear 91 in this lowered mode as well.

When the drive unit 20 is raised by the vertical actuator assembly 70, the respective axes, gears and brackets move in a reverse direction from that described above. As an example, the transfer gear 55 and transfer gear axis TA move upwardly, away from the input shaft axis IGA drive unit transitioned from the lowered mode to the raised mode. This all can occur as the transfer gear rotates about the transfer gear axis, the input gear rotates about the input shaft axis, and the idler gears rotate about the idler gear axis. For example, when the input shaft is imparting rotation through the drive assembly through all of the gears and ultimately to the propeller shaft and propeller of the drive unit, while the watercraft is moving in the water.

Further, the movement of the gears relative to one another as the drive unit moves from the lowered mode to the raised mode can be affected by the first guide element 97 interacting with the second guide element 87 associated with the idler bracket 83, which again can rotate relative to the adjuster plate and independently of the transfer gear 91. As the first guide element 97 moves linearly, and generally vertically within the standup box 30, the pin 98 interacts with the slot 87 and slides relative to it, while the pint also moved parallel to reference line M. As a result, the ear associated with the idler bracket 80 moves upward, generally rotating about the input shaft axis IGA, due to its securement to the proximal bracket 61. The distal bracket 90 to also moves upward, due to its attachment to the hub and the adjuster plate 96. Upward movement of the respective gears, brackets and shafts and other components can continue until the drive unit achieves the raised mode shown in FIGS. 1-4.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to" or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law, including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An outdrive for a watercraft having an inboard engine, the drive comprising:

an input shaft extending through a hole defined by a transom of the watercraft, a standoff box disposed rearward of the transom and joined with the transom, the input shaft extending into the standoff box;

an input gear joined with the input shaft and disposed in the standoff box;

an idler shaft rotatably disposed in the standoff box and configured to move along a curvilinear path;

a first idler gear joined with the idler shaft and configured to engage the input gear, thereby imparting rotation from the input shaft to the idler shaft;

a second idler gear joined with the idler shaft distal from the first idler gear, the second idler gear configured to rotate with the idler shaft;

a transfer gear engaged with the second idler gear such that rotation of the second idler gear is imparted to the transfer gear;

a transfer shaft rotatable upon rotation of the idler shaft;

a propeller shaft rotatable upon rotation of the transfer shaft; and a propeller joined with the propeller shaft and adapted to rotate therewith, thereby producing thrust to propel the watercraft through a body of water;

wherein the drive unit is operable in a raised mode, in which the propeller shaft is disposed a first distance from the standoff box, and in a lowered mode, in which the propeller shaft is disposed a second distance, greater than the first distance, from the standoff box.

2. The outdrive of claim 1, wherein in both the raised mode and the lowered mode, the propeller shaft is maintained at a fixed angle relative to a reference line projecting rearward from a bottom of the transom of the watercraft.

3. The outdrive of claim 1 comprising:

a proximal idler bracket that establishes a proximal offset distance between a first axis of the first idler gear and an input gear axis of the input gear;

a distal idler bracket distal from the proximal idler gear bracket that establishes a distal offset distance between a second axis of the second idler gear and a transfer gear axis of the transfer gear, wherein the proximal idler bracket and the distal idler bracket are disposed inside the standoff box interior, wherein the first axis and the second axis are coincident with one another.

4. The outdrive of claim 3, wherein the proximal offset distance is equal to the distal offset distance, wherein the proximal offset distance and distal offset distance are maintained while the idler shaft moves along the curvilinear path, as the drive unit transitions between the raised mode and the lowered mode.

5. The outdrive of claim 1, wherein the first idler gear and the second idler gear are joined with the idler shaft so that the first idler gear, second idler gear and idler shaft are configured to rotate in unison.

6. The outdrive of claim 1, wherein the transfer gear includes a transfer gear axis that moves upwardly away from an input shaft axis as the drive unit transitions from the lowered mode to the raised mode, and as the transfer gear rotates about the transfer gear axis, and as the input gear rotates about the input shaft axis.

7. The outdrive of claim 1, comprising:

a proximal idler bracket to which a first end of the idler shaft is rotatably joined;

a distal idler bracket to which a second end of the idler shaft is rotatably joined; and an intermediate idler bracket fixedly secured to the proximal idler bracket so that the intermediate idler bracket and the proximal idler bracket rotate in unison, wherein the intermediate idler bracket is disposed between the first idler gear and the second idler gear.

8. The outdrive of claim 7, wherein the intermediate idler bracket includes a tab defining a guide slot, wherein the transfer gear includes a transfer gear axis and a pin spaced distal from the transfer gear axis, wherein the pin moves in the slot as the drive unit transitions between the raised mode and the lowered mode.

9. The outdrive of claim 7, wherein the intermediate idler bracket defines an idler shaft hole, wherein the idler shaft extends through the idler shaft hole and rotates within the idler shaft hole.

10. The outdrive of claim 1, comprising:

a proximal idler bracket to which a first end of the idler shaft is rotatably joined;

a distal idler bracket to which a second end of the idler shaft is rotatably joined;

wherein the transfer gear includes a transfer gear axis, wherein a pin is parallel to the transfer gear axis, wherein the pin moves in the slot as the drive unit transitions between the raised mode and the lowered mode.

11. A standoff box for a watercraft having an in board engine, the standoff box comprising:

an input gear configured to be joined with an input shaft and disposed in the standoff box;

an idler shaft rotatably disposed in the standoff box;

a first idler gear joined with the idler shaft and configured to engage the input gear, thereby imparting rotation from the input shaft to the idler shaft, the first idler gear rotatable about an idler gear axis;

a second idler gear joined with the idler shaft;

a transfer gear rotationally coupled to the first idler gear such that rotation of the first idler gear is imparted to the transfer gear, the transfer gear rotatable about a transfer gear axis that is offset relative to the idler gear axis, the transfer gear being farther rear than the first idler gear; and a transfer shaft rotatable upon rotation of the idler shaft;

wherein the standoff box is configured to be joined with a drive unit having a propeller shaft rotatable upon rotation of the transfer shaft and a propeller joined with the propeller shaft, the drive unit being operable in a raised mode, in which the propeller shaft is disposed a first distance from the standoff box, and a lowered mode, in which the propeller shaft is disposed a second distance, greater than the first distance, from the standoff box.

12. A standoff box for a watercraft having an in board engine, the standoff box comprising:

an input gear configured to be joined with an input shaft and disposed in the standoff box;

an idler shaft rotatably disposed in the standoff box;

a first idler gear joined with the idler shaft and configured to engage the input gear, thereby imparting rotation from the input shaft to the idler shaft;

a transfer gear rotationally coupled to the first idler gear such that rotation of the first idler gear is imparted to the transfer gear;

a transfer shaft rotatable upon rotation of the idler shaft;

a second idler gear joined with the idler shaft distal from the first idler gear, the second idler gear configured to rotate with the idler shaft;

a proximal bracket disposed adjacent the input gear and rotatable relative to the input gear; and an idler bracket disposed between the first idler gear and the second idler gear, the idler bracket fixedly joined with the proximal bracket so the proximal bracket and the idler bracket rotate in unison, wherein the standoff box is configured to be joined with a drive unit having a propeller shaft rotatable upon rotation of the transfer shaft and a propeller joined with the propeller shaft, the drive unit being operable in a raised mode, in which the propeller shaft is disposed a first distance from the standoff box, and a lowered mode, in which the propeller shaft is disposed a second distance, greater than the first distance, from the standoff box.

13. The standoff box of claim 12, comprising:

a distal bracket disposed adjacent the transfer gear, the distal bracket being rotatably mounted relative to the transfer shaft and transfer gear.

14. The standoff box of claim 13 comprising:

a pin joined moveable with the drive unit, a guide joined with the idler bracket, wherein the pin interfaces with the guide to selectively rotate the idler bracket when the drive unit moves from the raised mode to the lowered mode.

15. A standoff box for a watercraft having an in board engine, the standoff box comprising:

an input gear configured to be joined with an input shaft and disposed in the standoff box;

an idler shaft rotatably disposed in the standoff box;

a first idler gear joined with the idler shaft and configured to engage the input gear, thereby imparting rotation from the input shaft to the idler shaft;

a transfer gear rotationally coupled to the first idler gear such that rotation of the first idler gear is imparted to the transfer gear; and a transfer shaft rotatable upon rotation of the idler shaft, wherein the standoff box is configured to be joined with a drive unit having a propeller shaft rotatable upon rotation of the transfer shaft and a propeller joined with the propeller shaft, the drive unit being operable in a raised mode, in which the propeller shaft is disposed a first distance from the standoff box, and a lowered mode, in which the propeller shaft is disposed a second distance, greater than the first distance, from the standoff box, wherein the first idler gear rotates about an idler gear axis, wherein the input gear rotates about an input gear axis, wherein the transfer gear rotates about a transfer gear axis, wherein the input gear axis and the transfer gear axis move closer to one another, but wherein the idler gear axis remains at a fixed distance from the input gear axis and from the transfer gear axis, when the drive unit is at least one of lowered and raised.

16. A standoff box for a watercraft having an in board engine, the standoff box comprising:

an input gear configured to be joined with an input shaft and disposed in the standoff box;

an idler shaft rotatably disposed in the standoff box;

a first idler gear joined with the idler shaft and configured to engage the input gear, thereby imparting rotation from the input shaft to the idler shaft;

a transfer gear rotationally coupled to the first idler gear such that rotation of the first idler gear is imparted to the transfer gear;

a transfer shaft rotatable upon rotation of the idler shaft;

a first guide element oriented relative to the transfer shaft at a fixed distance; and a second guide element joined with an idler bracket joined with the idler shaft, wherein the standoff box is configured to be joined with a drive unit having a propeller shaft rotatable upon rotation of the transfer shaft and a propeller joined with the propeller shaft, the drive unit being operable in a raised mode, in which the propeller shaft is disposed a first distance from the standoff box, and a lowered mode, in which the propeller shaft is disposed a second distance, greater than the first distance, from the standoff box, wherein the first guide element interfaces with the second guide element as the drive unit is lowered, so as to rotate the idler bracket about an idler shaft axis.

17. The standoff box of claim 16, wherein the first guide element includes a pin, wherein the second guide element includes a slot within which the pin is slidably disposed.

18. A method of operating a watercraft comprising:

rotating an input shaft and an input gear in a standoff box;

rotating a first idler gear joined with an idler shaft with the input gear;

rotating a second idler gear joined with the idler shaft distal from the first idler gear;

rotating a transfer gear engaged with the second idler gear;

rotating a transfer shaft with the transfer gear;

wherein the first and second idler gears rotate about an idler gear axis, wherein the input gear rotates about an input gear axis, wherein the transfer gear rotates about a transfer gear axis to subsequently rotate a propeller shaft of a drive unit, wherein the input gear axis and the transfer gear axis move closer to one another, but wherein the idler gear axis remains at a fixed distance from the input gear axis and from the transfer gear axis, when the drive unit is at least one of lowered and raised.

19. The method of claim 18, wherein the standoff box includes a lift element that facilitates movement of the drive unit to a raised mode, in which the propeller shaft is disposed a first distance from the standoff box, and to a lowered mode, in which the propeller shaft is disposed a second distance, greater than the first distance, from the standoff box.

20. The method of claim 18 comprising:

moving a first guide element when the drive unit is at least one of lowered and raised, so as to engage a second guide element with the first guide element, wherein the second guide element is associated with the idler shaft so that the idler shaft moves up or down while maintaining the idler gear axis at the fixed distance from the input gear axis and from the transfer gear axis.

* * * * *